US008640518B1

(12) United States Patent
Saito

(10) Patent No.: US 8,640,518 B1
(45) Date of Patent: Feb. 4, 2014

(54) BURRING APPARATUS WITH SCRAP REMOVING CAPABILITY

(71) Applicant: Hirofumi Saito, Chula Vista, CA (US)

(72) Inventor: Hirofumi Saito, Chula Vista, CA (US)

( * ) Notice: Subject to any disclaimer, the term of this patent is extended or adjusted under 35 U.S.C. 154(b) by 0 days.

(21) Appl. No.: 13/860,661

(22) Filed: Apr. 11, 2013

(51) Int. Cl.
*B21D 31/02* (2006.01)
*B21D 28/00* (2006.01)

(52) U.S. Cl.
USPC ..... 72/325; 72/333

(58) Field of Classification Search
USPC ..... 72/39, 40, 324, 325, 326, 328, 332, 333
See application file for complete search history.

(56) References Cited

U.S. PATENT DOCUMENTS 3,646,797 A * 3/1972 Overway ..... 72/326
4,107,541 A * 8/1978 Kirsch ..... 250/559.4

* cited by examiner

*Primary Examiner* — Teresa M Ekiert
(74) *Attorney, Agent, or Firm* — LambentIP

(57) ABSTRACT

A burring apparatus is provided, including a burring die having a top surface for a workpiece to be placed on, the burring die configured to be cylindrically symmetric with a burring hole formed concentrically therein to provide an inner surface, a burring punch having a tip end portion for punching the workpiece to cut off a metal piece and a tip portion for pressing a remaining portion of the workpiece warped in the burring hole to form a boss, and a scrap removing unit attached to the inner surface of the burring die, wherein the burring punch, the burring die and the scrap removing unit are configured to trap, push out and let fall by scraping off the metal piece as the burring punch is lowered into the burring hole and lifted.

12 Claims, 8 Drawing Sheets

BURRING APPARATUS WITH SCRAP REMOVING CAPABILITY

BACKGROUND

Burring is a machining technique involving punching a hole in a workpiece such as a metal sheet to form a flange (or a boss) along the edge of the hole. A burring apparatus typically includes a burring punch and a burring die, inside of which a burring hole is formed. A workpiece is placed on the top stage of the die, and a tip of the burring punch is pressed onto the workpiece above the burring hole so as to make a hole with a boss in the workpiece by punching off the corresponding metal piece. These punched-off metal pieces are scraps that need to be discarded properly. In a conventional burring process, however, it is often the case that these scraps get magnetized and attached to the tip of the burring punch, thereby interfering with the subsequent punching operation, or attached to the newly formed boss, thereby requiring cleaning of the product.

DETAILED DESCRIPTION

Figure 1:
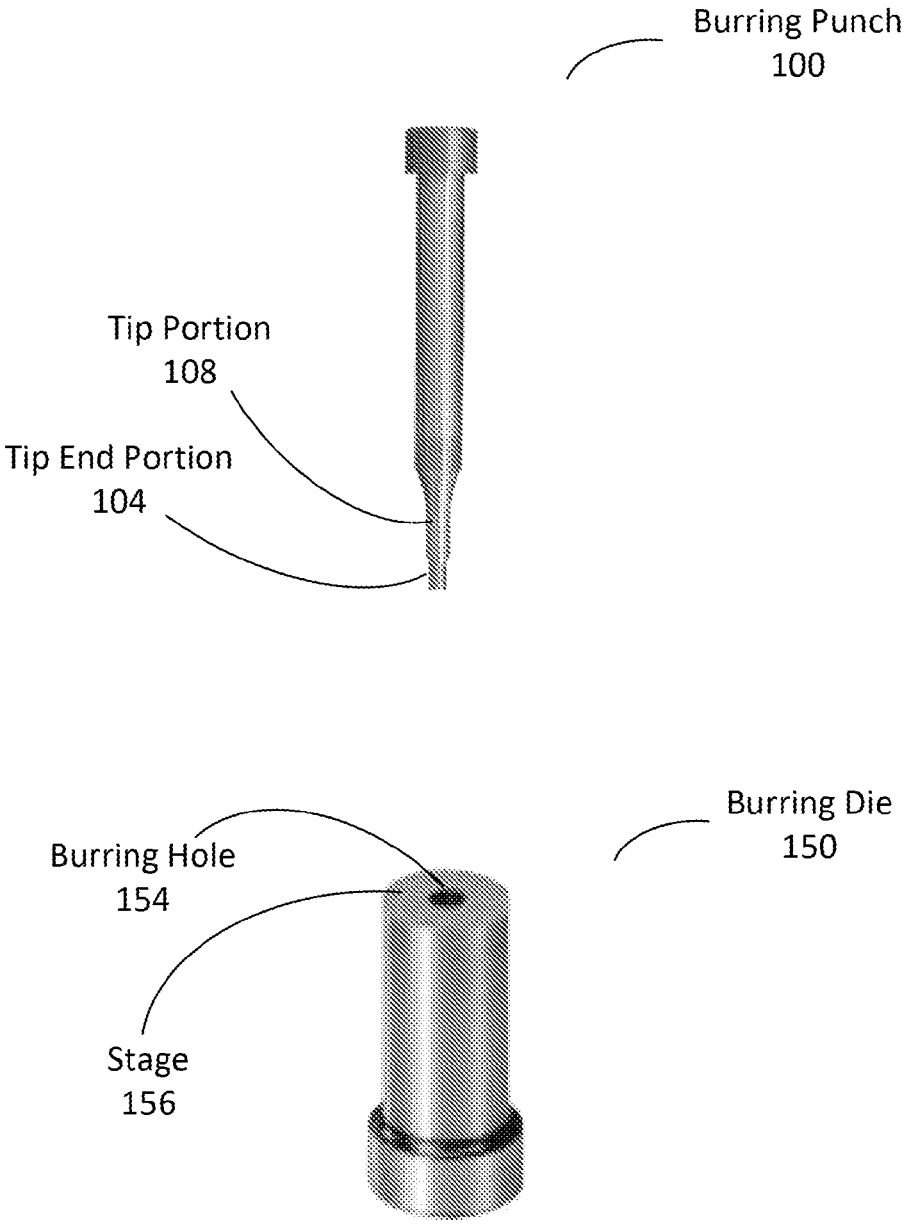
Prior Art FIG. 1
FIG. 1 illustrates a conventional burring apparatus having a burring punch and a burring die.

FIG. 1 illustrates a conventional burring apparatus having a burring punch 100 and a burring die 150. The overall shape of the burring punch 100 is of a rod, having a tip including a tip end portion 104 and tip portion 108. Each shape of the burring punch 100 and the burring die 150 is cylindrically symmetric. The diameter of the tip portion 108 is configured to be substantially the same as an inner diameter of a boss to be fabricated. A burring hole 154 is formed along the cylindrical axis of the burring die 150 and concentrically therewith. The diameter of the burring hole 154 is configured to be substantially the same as an outer diameter of the boss to be fabricated. The top surface of the burring die 150 is a stage 156 having a concentric ring shape for a workpiece to be placed on.

Figure 2:
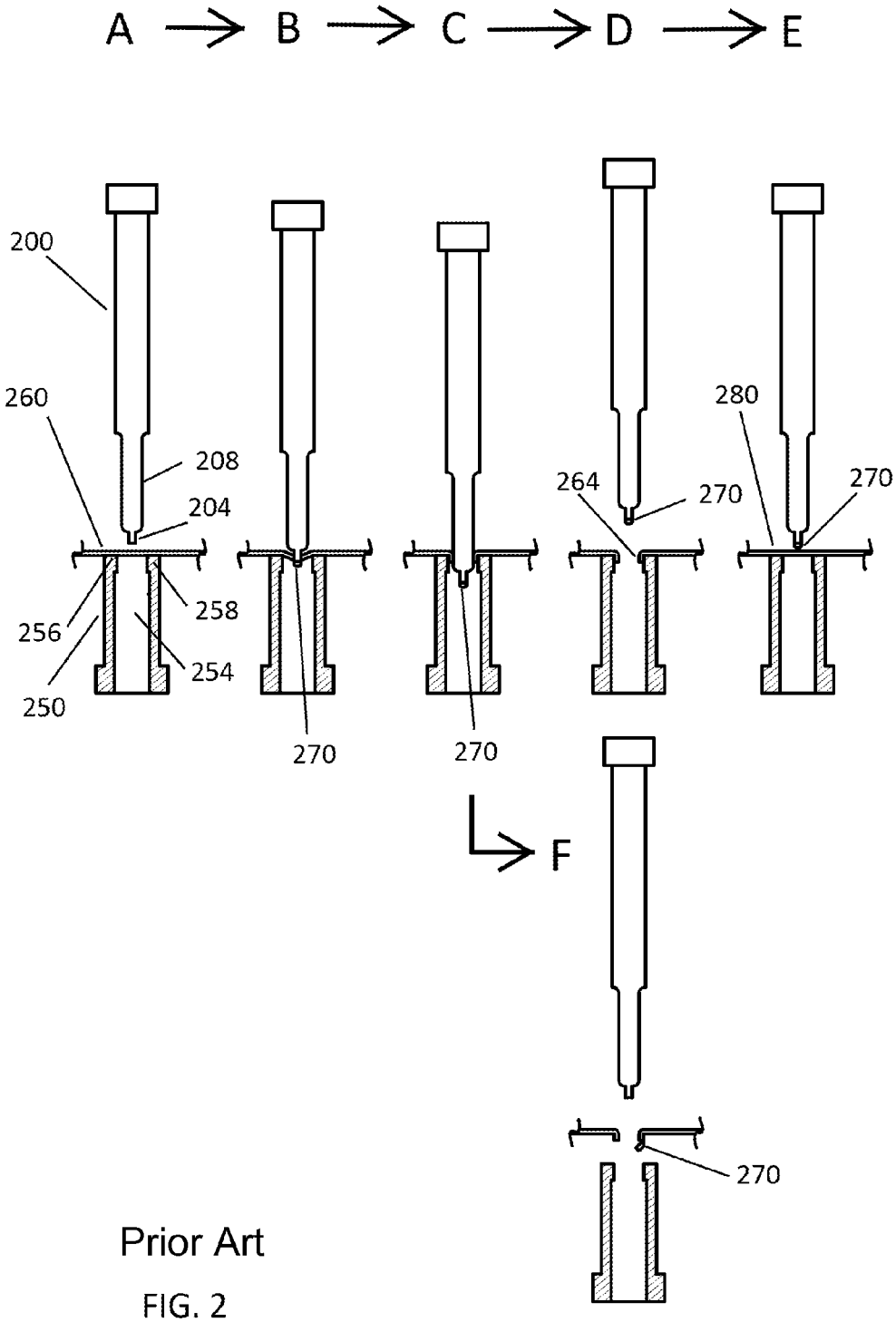
Prior Art FIG. 2
FIG. 2 illustrates examples of burring processes, A-B-C-D-E and A-B-C-F, where a conventional burring apparatus is used.

FIG. 2 illustrates examples of burring processes, A-B-C-D-E and A-B-C-F, where a conventional burring apparatus is used. Each of a burring punch 200 and a burring die 250 has a cylindrically symmetric shape; each step of the burring process is illustrated by a cross-sectional side view with respect the vertical plane having the cylindrical axis. The burring punch 200 includes a tip end portion 204 and a tip portion 208. The burring die 250 has a burring hole 254 that is formed concentrically inside the burring die 250 and along the cylindrical axis. In this example, the diameter of the burring hole 254 is configured to be smaller at the top part than the below part, providing a neck portion 258 of the burring die 250. Above the neck portion 258 is a flat top surface having a concentric ring shape, as illustrated in FIG. 1, providing a stage 256 for a workpiece 260, such as a metal sheet, to be placed on. Step A illustrates that the workpiece 260 is placed on the stage 256 of the burring die 250, and the burring punch 200 is properly positioned and standing by for the burring operation. When the operation is initiated, in step B, the burring punch 200 is lowered vertically to press the workpiece 260 causing the workpiece 260 to warp downward into the burring hole 254, and eventually cutting off a metal piece 270 by the tip end portion 204. In step C, the burring punch 200 is further lowered to press horizontally, by the tip portion 208, the remaining portion of the workpiece 260 in the burring hole 254 against the inner surface of the neck portion 258. In step C, the cut-off metal piece 270 is attached to the tip end portion 204, due possibly to magnetization. In step D, the burring punch 200 is lifted vertically away from the burring hole 254, and a boss 264 is formed around the inner surface of the neck portion 258. As a result, the desired product, i.e., the boss 264 is fabricated, but the metal piece 270 is still attached to the tip end portion 204 of the burring punch 200. There is a possibility that the metal piece 270 is attached to the tip portion 208, the boss 264 or the workpiece 260, in addition to the tip end portion 204 as illustrated in FIG. 2. To repeat the operation to make a boss using another workpiece, in step E, a new workpiece 280 is placed on the stage 256 of the burring die 250. However, the metal piece 270 remains attached to the tip end portion 204 of the burring punch 200, thereby interfering the subsequent burring operation, degrading the quality of the resultant boss, or even damaging the tip end portion 204. Another possibility is illustrated in step F, in which, after step C, the cut-off metal piece 270 is attached to the boss 264 that has just formed, requiring cleaning of the product or generating scratches to the product during the subsequent handling.

In view of the above problems associated with the generation of metal pieces (scraps) during the burring process, the present document describes a new type of burring apparatus comprising a burring punch, a burring die and a scrap removing unit attached to the burring die. Details of the burring apparatus according to present embodiments are explained below with reference to the subsequent drawings.

Figure 3:
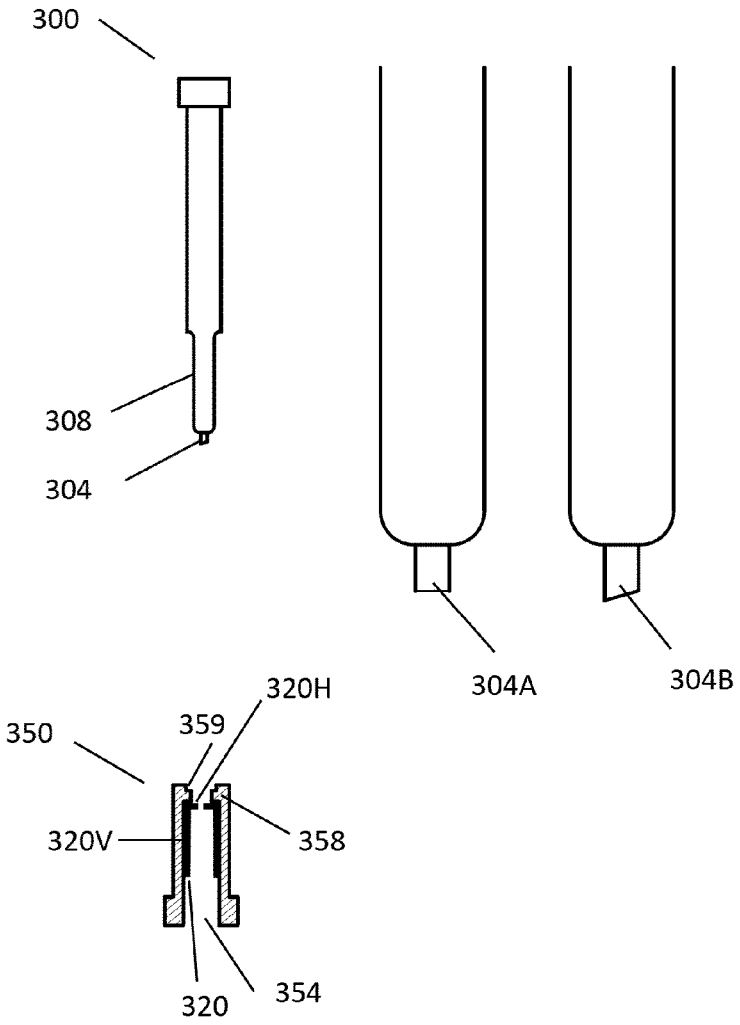
FIG. 3 illustrates a burring punch and a burring die according to present embodiments.

FIG. 3 illustrates a burring punch and a burring die according to the present embodiments. The overall shape of the burring punch 300 is of a rod, having a tip including a tip end portion 304 and a tip portion 308. The tip end portion 304 may be configured to have a straight end, as exemplified by the tip end portion 304A. Alternatively, the tip end portion 304 may be configured to have a slant end, as exemplified by the tip end portion 304B. The burring die 350 has a cylindrically symmetric shape; the structure is illustrated by a cross-sectional side view with respect to the vertical plane having the cylindrical axis. A burring hole 354 is formed concentrically with the outer surface of the burring die 350, providing an inner surface. The burring die 350 includes a scrap removing unit 320, which is configured to be located in the burring hole 354 and attached to the inner surface below a neck portion 358 of the burring die 350. Above the neck portion 358, a recessed portion 359 is formed in this example. The shape of the scrap removing unit 320 is also cylindrically symmetric, and is configured to have a horizontal portion 320H and a vertical portion 320V. The cross-sectional side view of the scrap removing unit 320 with respect to the vertical plane having the cylindrical axis resembles a pair of L-shaped parts facing each other in this example in FIG. 3.

Figure 4:
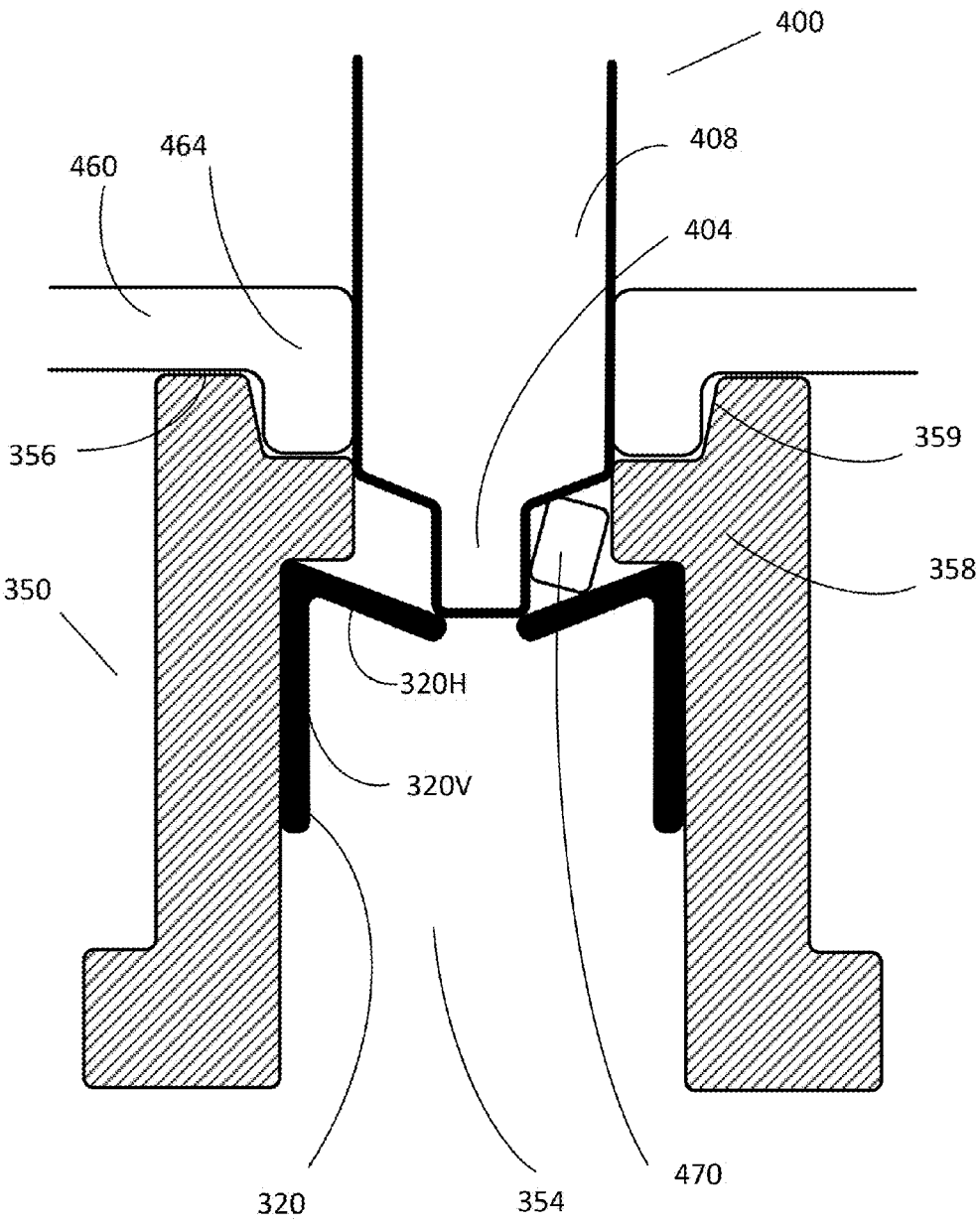
FIG. 4 illustrates an expanded view of the burring die with a burring punch inserted into the burring hole and a workpiece having a boss already formed.

FIG. 4 illustrates an expanded view of the burring die 350 with a burring punch 400 inserted into the burring hole 354 and a workpiece 460 having a boss 464 already formed. A metal piece 470 is a scrap to be removed, and was formed by the punching action wherein the tip end portion 404 of the burring punch 400 is pressed onto the workpiece 460, thereby cutting off the metal piece 470. Thus, one dimension of the metal piece 470 is substantially the same as the diameter of the tip end portion 404. The length of the neck portion 358, the length of the tip end portion 404, the diameter of the tip portion 408 and the length of the horizontal portion 320H are configured so as to effectively trap the metal piece 470 in the gap surrounded by at least parts of the tip end portion 404, the tip portion 408, the neck portion 358 and the horizontal portion 320H and to eventually push it out from the gap as illustrated below.

Figure 4A:
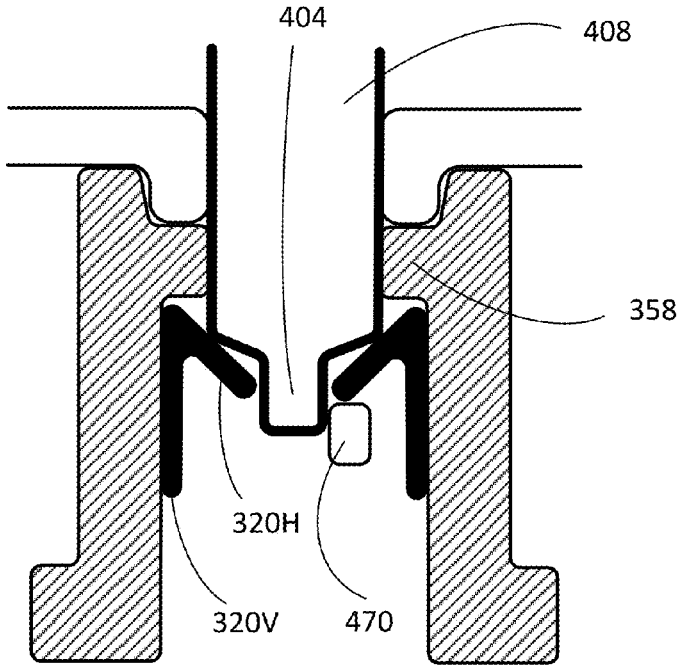
FIG. 4A illustrates an expanded view of the burring die with the workpiece having the boss already formed when the burring punch is further lowered from the position in FIG. 4.

FIG. 4A illustrates an expanded view of the burring die 350 with the workpiece 460 having the boss 464 already formed when the burring punch 400 is further lowered from the position in FIG. 4, where the reference numerals commonly refer to the same parts in FIGS. 4 and 4A. As the burring punch 400 is further lowered from the position in FIG. 4, the horizontal portion 320H of the scrap removing unit 320 is further bent downward by the shoulder part of the tip portion 408, and the metal piece 470 is pushed out of the gap. However, the metal piece 470 may still be attached to the tip end portion 404 or the tip portion 408.

Figure 4B:
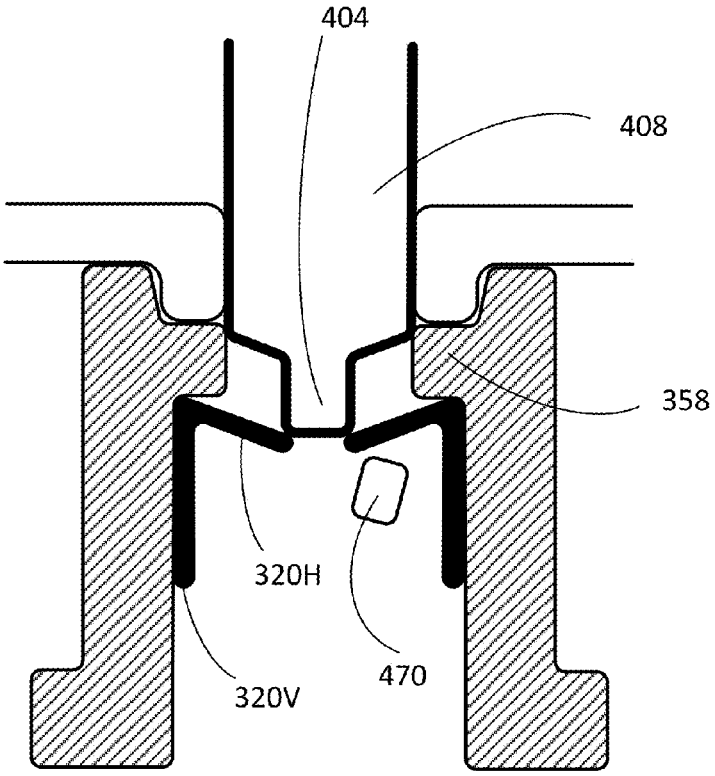
FIG. 4B illustrates an expanded view of the burring die with the workpiece having the boss already formed when the burring punch is lifted from the position in FIG. 4A.

FIG. 4B illustrates an expanded view of the burring die 350 with the workpiece 460 having the boss 464 already formed when the burring punch 400 is lifted from the position in FIG. 4A, where the reference numerals commonly refer to the same parts in FIGS. 4, 4A and 4B. The dimensions and shape of the horizontal portion 320H are configured to effectively scrape the metal piece 470 from the tip end portion 404 or the tip portion 408, as the barring punch 400 is lifted and the horizontal portion 320H is released up. As a result, the metal piece 470 will detach from the tip end portion 404 or the tip portion 408 and fall in the barring hole 354 below the scrap removing unit 320.

As the burring punch 400 moves up and down many times during the burring operation, the horizontal portion 320H of the scrap removing unit 320 is pushed down and released up by the tip end 404 portion and the tip portion 408 many times, thereby undergoing multiple flapping motions during the burring operation. Therefore, it is preferable that the scrap removing unit 320 is made of a material that is elastic, mechanically durable and non-magnetic, such as a stainless steel.

The tip end portion 404 may be configured to have a slant end, such as 304B in FIG. 3. This configuration may increase the probability of pushing the metal piece 470 sideways when the burring punch 400 is lowered, instead of leaving the metal piece 470 attached to the tip end portion 404.

Furthermore, the inner surface of the recessed portion 359 of the burring die 350 may be configured to be tapered, as exemplified in FIG. 4. The taper length and angle should be determined based on the material characteristics and thickness of the workpiece 460, so that the resultant boss 464 is of good quality. The advantage of having the tapered recessed portion 359 is that the top opening of the burring die 350 has a large diameter, so that, even if the center axis of the burring punch 400 is shifted horizontally due to lack of maintenance, for example, the probability of the tip end portion 404 hitting the edge of the opening is small. In general, a ceramic is not used for a burring punch, since it is known to those skilled in the art that a tip made of a ceramic is weak to a horizontal impact, which may occur when the tip end portion 404 hits the inner edge of the stage 356. Thus, the present configuration having the tapered recessed portion 359 may allow for the use of a brittle but cheap non-magnetic material, such as a ceramic, for the burring punch 400.

Figure 5:
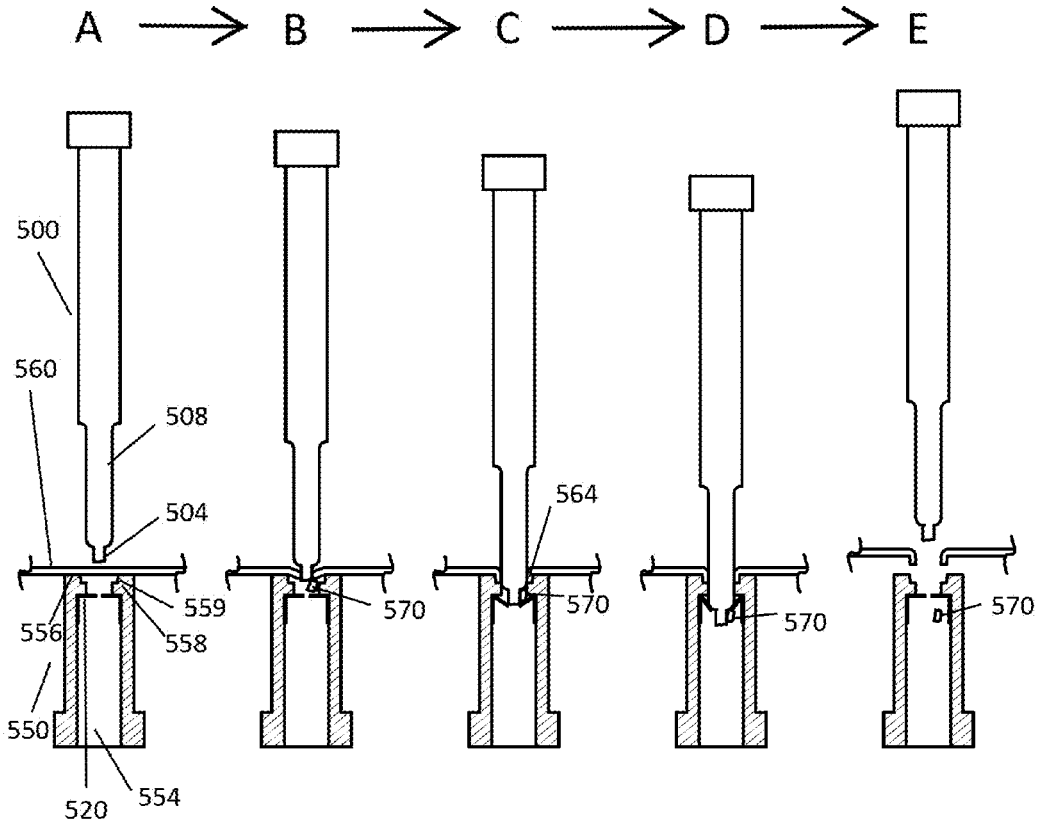
FIG. 5 illustrates an example of a burring process, A-B-C-D-E, where a burring apparatus according to the present embodiments is used.

FIG. 5 illustrates an example of a burring process, A-B-C-D-E, where a burring apparatus according to the present embodiments is used. Each of a burring punch 500 and a burring die 550 has a cylindrically symmetric shape (except when the tip end portion 504 is configured to have a slant end, such as 304B in FIG. 3); each step of the burring process is illustrated by a cross-sectional side view with respect the vertical plane having the cylindrical axis. The burring punch 500 includes a tip end portion 504 and a tip portion 508. The burring die 550 has a burring hole 554 that is formed concentrically inside the burring die 550 and along the cylindrical axis, providing an inner surface. The burring die 550 includes a scrap removing unit 520 which is configured to be located in the burring hole 554 and attached to the inner surface below a neck portion 558 of the burring die 550. Above the neck portion 558, a recessed portion 559 is formed. The shape of the scrap removing unit 520 is also cylindrically symmetric, and is configured to have a horizontal portion and a vertical portion. The cross-sectional side view of the scrap removing unit 520 with respect to the vertical plane having the cylindrical axis resembles a pair of L-shaped parts facing each other in this example. Step A illustrates that the workpiece 560, such as a metal sheet, is placed on the stage 556 of the burring die 550, and the burring punch 500 is properly positioned and standing by for the burring operation. When the operation is initiated, in step B, the burring punch 500 is lowered vertically to press the workpiece 560 causing the workpiece 560 to warp downward into the burring hole 554, and eventually cutting off a metal piece 570 by the tip end portion 504. Step C is close to the situation illustrated in FIG. 4. In this step C, the burring punch 500 is further lowered to press horizontally, by the tip portion 508, the remaining portion of the workpiece 560 in the burring hole 554 against the inner surface of the recessed portion 559, so as to form a boss 564. In addition, the horizontal portion of the scrap removing unit 520 is pushed by the tip end portion 504 and bent downward, and the cut-off metal piece 570 is trapped in the gap surrounded by at least parts of the tip end portion 504, the tip portion 508, the neck portion 558 and the horizontal portion of the scrap removing unit 520. In step D, the burring punch 500 is further lowered, and the horizontal portion of the scrap removing unit 520 is further bent downward by the tip portion 508, thereby pushing the metal piece 570 out of the gap. Step D is close to the situation illustrated in FIG. 4A. After the step D, a situation close to the one illustrated in FIG. 4B will follow, wherein the metal piece 570 is scraped off from the tip end portion 504 or the tip portion 508, as the burring punch 500 is lifted and the horizontal portion of the scrap removing unit 520 is released up. As a result, the metal piece 570 will detach from the tip end portion 504 or the tip portion 508. In step E, the burring punch 500 is lifted vertically away from the burring hole 554, and the workpiece 560 having the formed boss 564 is removed from the stage 556. The metal piece 570 falls in the burring hole 554 to be properly discarded. Therefore, unlike the processes by using a conventional burring apparatus illustrated in FIG. 2, the metal piece 570 is not attached to the tip end portion 504 or the tip portion 508, nor is it attached to the boss 564 or to the workpiece 560, owing to the configuration of the burring die 550 including the scrap removing unit 520. The tip end portion 504 may be configured to have a slant end, such as 304H in FIG. 3. This configuration may increase the probability of pushing the metal piece 570 sideways as the burring punch 500 is lowered, instead of leaving the metal piece 570 attached to the tip end portion 504.

Figure 6C:
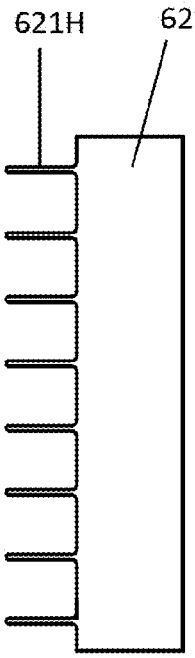
FIGS. 6C-6F illustrate details of fabricating the scrap removing unit illustrated in FIGS. 6A and 6B.
Figure 6D:
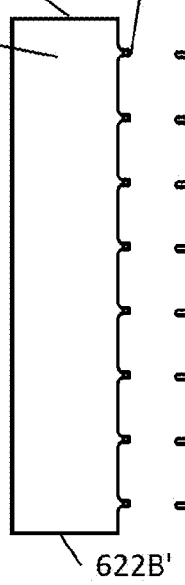
Figure 6E:
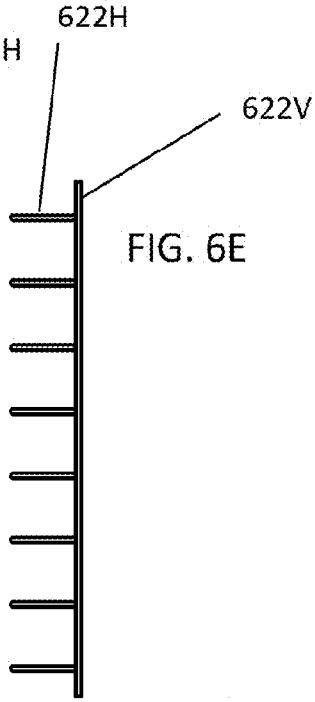
Figure 6A:
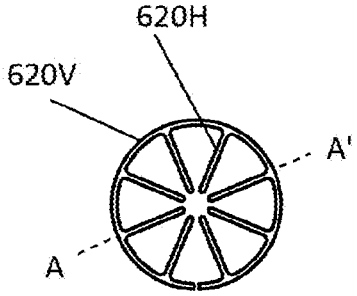
FIGS. 6A and 6B illustrate details of a structure of an example of a scrap removing unit.
Figure 6B:
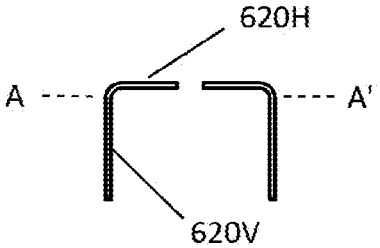

FIGS. 6A and 6B illustrate details of a structure of an example of a scrap removing unit. FIG. 6A is a top view of this structure. FIG. 6B is a cross-sectional side view with respect to the vertical plane cutting though the line A-A'. This structure has a horizontal portion 620H having multiple flaps and a vertical, portion 620V that has substantially a hollow-cylindrical shape. Each of the multiple flaps in this example has a thin rectangular shape like a pin connected to the vertical portion 620V at one end, and these flaps are radially placed so as to point toward the center, i.e., the cylindrical axis. As the burring punch moves up and down many times during the burring operation, the horizontal portion 620H is pushed down and released up many times, thereby undergoing multiple flapping motions. Therefore, it is preferable that the scrap removing unit is made of a material that is elastic, mechanically durable and non-magnetic, such as a stainless steel. The dimensions and shape of each flap should be determined so as to effectively scrape off and detach a metal piece, i.e., a scrap, from the tip end portion or the tip portion, as in the process illustrated in FIG. 5.

Figure 6F:
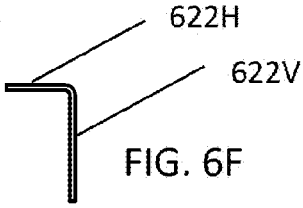

FIGS. 6C-6F illustrate details of fabricating the scrap removing unit illustrated in FIGS. 6A and 6B. First, a planar pattern as illustrated in FIG. 6C may be cut out from a metal sheet, such as a stainless steel. This pattern has a portion 621H having multiple thin rectangles connected to a portion 621V that is a large rectangle. The portion 621H is to be the horizontal portion 620H, and the portion 621V is to be the vertical portion 620V after the fabrication. Second, as illustrated in FIGS. 6D-6F, the planar pattern in FIG. 6C is bent along the edge of the large rectangle 621V where the multiple thin rectangles 620H are connected, so that the portions 621V and 621H form substantially a 90° angle. FIG. 6D is a front view after the 90° bending. The portion 622V having the large rectangle is connected to the portion 622H having the multiple thin rectangles that have been bent by 90° so as to point toward the direction perpendicular to the plane having the portion 622V. FIG. 6E is a top view after the 90° bending. The portion 622H and the portion 622V form the 90° angle, where the portion 622V points toward the direction perpendicular to the plane having the portion 622H. FIG. 6F illustrates a side view after the 90° bending. The portion 622H and the portion 622V form the 90° angle, where the portion 622V points toward the vertical direction, and the portion 622H points toward the horizontal direction. After the 90° bending, the structure is warped around so that the edges 622B and 622B' of the portion 622V are joined to form substantially a hollow-cylindrical shape from the portion 622V to which the portion 622H is perpendicularly connected. The resultant three-dimensional structure is the scrap removing unit having the horizontal portion 620H and the vertical portion 620V as illustrated in FIGS. 6A and 6B.

Figure 7C:
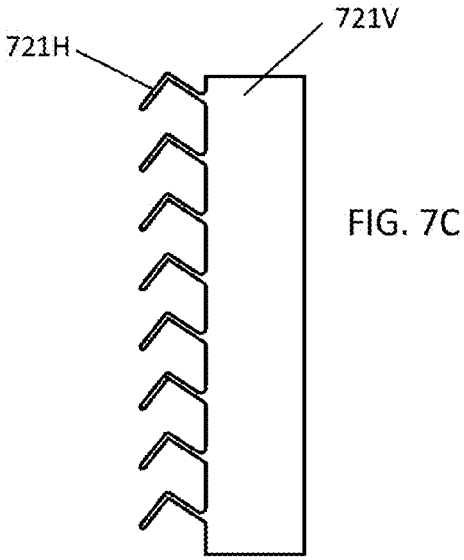
FIGS. 7C-7F illustrate details of fabricating the scrap removing unit illustrated in FIGS. 7A and 7B.
Figure 7D:
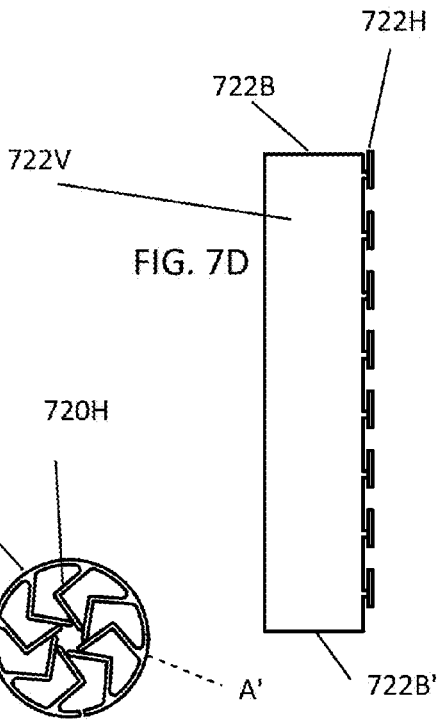
Figure 7E:
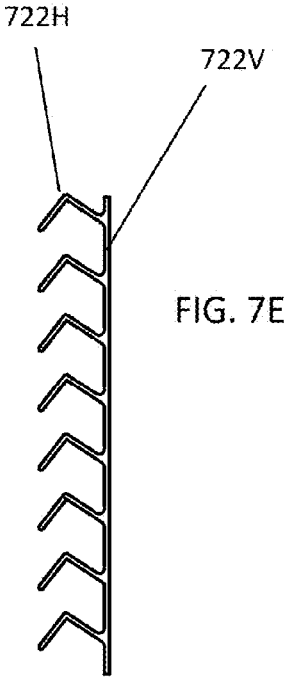
Figure 7A:
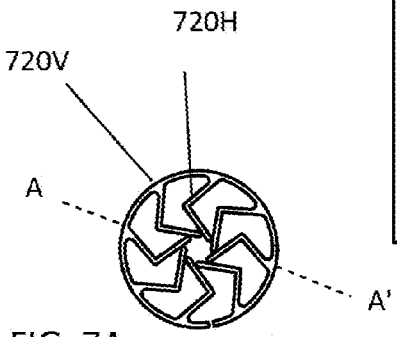
FIGS. 7A and 7B illustrate details of a structure of another example of a scrap removing unit.
Figure 7B:
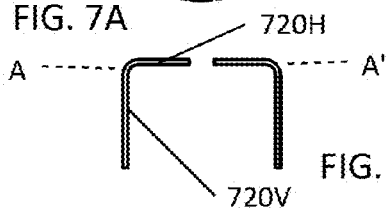

FIGS. 7A and 7B illustrate details of a structure of another example of a scrap removing unit. FIG. 7A is a top view of this structure. FIG. 7B is a cross-sectional side view with respect to the vertical plane cutting though the line A-A'. This structure has a horizontal portion 720H having multiple flaps and a vertical portion 720V that has substantially a hollow-cylindrical shape. Each of the multiple flaps in this example has a thin bent rectangular shape like a bent arm connected to the vertical portion 720V at one end, and these flaps are radially placed so as to point substantially toward the center, i.e., the cylindrical axis. As the burring punch moves up and down many times during the burring operation, the horizontal portion 720H is pushed down and released up many times, thereby undergoing multiple flapping motions. Therefore, it is preferable that the scrap removing unit is made of a material that is elastic, mechanically durable and non-magnetic, such as a stainless steel. The dimensions and shape of each flap should be determined so as to effectively scrape off and detach a metal piece, i.e., a scrap, from the tip end portion or the tip portion, as in the process illustrated in FIG. 5.

Figure 7F:
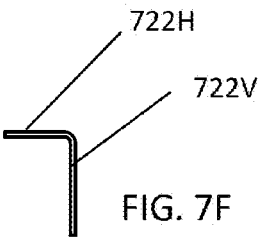

FIGS. 7C-7F illustrate details of fabricating the scrap removing unit illustrated in FIGS. 7A and 7B. First, a planar pattern as illustrated in FIG. 7C may be cut out from a metal sheet, such as a stainless steel. This pattern has a portion 721H having multiple thin bent rectangles connected to a portion 721V that is a large rectangle. The portion 721H is to be the horizontal portion 720H, and the portion 721V is to be the vertical portion 720V after the fabrication. Second, as illustrated in FIGS. 7D-7F, the planar pattern in FIG. 7C is bent along the edge of the large rectangle 721V where the multiple thin bent rectangles 720H are connected, so that the portions 721V and 721H form substantially a 90° angle. FIG. 7D is a front view after the 90° bending. The portion 722V having the large rectangle is connected to the portion 722H having the multiple thin bent rectangles that have been bent by 90° so as to point toward the direction perpendicular to the plane having the portion 722V. FIG. 7E is a top view after the 90° bending. The portion 722H and the portion 722V form the 90° angle, where the portion 722V points toward the direction perpendicular to the plane having the portion 722H. FIG. 7F illustrates a side view after the 90° bending. The portion 722H and the portion 722V form the 90® angle, where the portion 722V points toward the vertical direction, and the portion 722H points toward the horizontal direction. After the 90° bending, the structure is warped around so that the edges 722B and 722B' of the portion 722V are joined to form substantially a hollow-cylindrical shape from the portion 722V to which the portion 722H is perpendicularly connected. The resultant three-dimensional structure is the scrap removing unit having the horizontal portion 720H and the vertical portion 720V as illustrated in FIGS. 7A and 7B.

FIGS. 6 and 7 illustrate only two examples of structures of the scrap removing unit. Additionally or alternatively, different designs may be devised by varying the shape and dimensions of the horizontal flaps to trap and then scrape off a scrap, as illustrated in the process in FIG. 5.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed is:

1. A burring apparatus comprising:

a burring die having a top surface for a workpiece to be placed on, the burring die configured to be cylindrically symmetric with a burring hole formed concentrically therein to provide an inner surface;

a burring punch having a tip end portion for punching the workpiece to cut off a metal piece and a tip portion for pressing a remaining portion of the workpiece warped in the burring hole to form a boss; and a scrap removing unit attached to the inner surface of the burring die, wherein the burring punch, the burring die and the scrap removing unit are configured to trap, push out and let fall by scraping off the metal piece as the burring punch is lowered into the burring hole and lifted.

2. The burring apparatus of claim 1, wherein the burring die has a neck portion, wherein a diameter of the inner surface of the neck portion is smaller than that of the inner surface of a portion below the neck portion; and the burring die further has a recessed portion above the neck portion, wherein a diameter of the inner surface of the recessed portion is larger than that of the inner surface of the neck portion.

3. The burring apparatus of claim 2, wherein the inner surface of the recessed portion is tapered, wherein an opening at the top surface has a diameter larger than that of an untapered inner surface to reduce probability of the tip end portion hitting an edge of the opening.

4. The burring apparatus of claim 3, wherein the burring punch is made of a ceramic.

5. The burning apparatus of claim 2, wherein the scrap removing unit has a cylindrically symmetric shape and comprises a horizontal portion and a vertical portion, wherein the vertical portion is configured to have substantially a hollow-cylindrical shape to be attached to the inner surface of the burring die; and the horizontal portion is configured to have a plurality of flaps radially placed so as to point toward a cylindrical axis, each of the plurality of flaps connected to the vertical portion at one end.

6. The burring apparatus of claim 5, wherein a length of the neck portion, a length of the tip end portion, a diameter of the tip portion and a length of the horizontal portion of the scrap removing unit are configured to effectively trap the metal piece in a gap surrounded by at least parts of the tip end portion, the tip portion, the neck portion and the horizontal portion as the burring punch is lowered into the burring hole, and to push out the metal piece from the gap as the burring punch is further lowered; and dimensions and a shape of each flap are configured to effectively scrape off the metal piece to detach from the tip end portion or the tip portion to fall in the burring hole as the burring punch is lifted from a lowered position.

7. The burring apparatus of claim 1, wherein the tip end portion is configured to have a slant end to increase probability of pushing the metal piece sideways as the burring punch is lowered.

8. The burring apparatus of claim 1, wherein the scrap removing unit is made of a stainless steel.

9. A burring method using a burring apparatus comprising: a burring die having a top surface and configured to be cylindrically symmetric with a burring hole formed concentrically therein to provide an inner surface; a burring punch having a tip end portion and a tip portion; and a scrap removing unit attached to the inner surface of the burring die, the method comprising:

placing a workpiece on the top surface of the burring die;

first lowering the burring punch to press the workpiece downward to make the workpiece warp into the burring hole;

second lowering, further from the first lowering, the burring punch to cut off a metal piece by the tip end portion and press by the tip portion a remaining portion of the warped workpiece to the inner surface of the burring hole to form a boss;

third lowering, further from the second lowering, the burring punch to trap the metal piece in a gap surrounded by at least parts of the tip end portion, the tip portion, the inner surface of the burring hole and the scrap removing unit;

fourth lowering, further from the third lowering, the burring punch to push out the metal piece from the gap; and lifting, from the fourth lowering, the burring punch to scrape off the metal piece from the tip end portion or the tip portion by a part of the scrap removing unit.

10. The burring method of claim 9, wherein the scrap removing unit has a cylindrically symmetric shape and comprises a horizontal portion and a vertical portion, wherein the horizontal portion is used to scrape off the metal piece from the tip end portion or the tip portion in the lifting.

11. The burring method of claim 9, wherein the burring die has a neck portion, wherein a diameter of the inner surface of the neck portion is smaller than that of the inner surface of a portion below the neck portion; and the burring die further has a recessed portion above the neck portion, wherein a diameter of the inner surface of the recessed portion is larger than that of the inner surface of the neck portion, wherein the inner surface of the neck portion is used to form the gap in the third lowering.

12. The burring method of claim 11, wherein the inner surface of the recessed portion is tapered, wherein an opening at the top surface has a diameter larger than that of an untapered inner surface to reduce probability of the tip end portion hitting an edge of the opening, allowing for use of a burring punch made of a ceramic.

* * * * *